US006308033B1

(12) United States Patent
Kato

(10) Patent No.: US 6,308,033 B1
(45) Date of Patent: Oct. 23, 2001

(54) IMAGE FORMING METHOD AND APPARATUS USING CHARGED PARTICLES

(75) Inventor: Keishi Kato, Kaisei-machi (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/585,287

(22) Filed: Jun. 2, 2000

(30) Foreign Application Priority Data

Jun. 2, 1999 (JP) ..... 11-155254
Jun. 2, 1999 (JP) ..... 11-155255

(51) Int. Cl.[7] ..... G03G 15/10

(52) U.S. Cl. ..... 399/241; 399/237; 399/291; 430/117

(58) Field of Search ..... 399/237, 241, 399/244, 246, 266, 290, 291; 347/55, 103; 430/117, 118

(56) References Cited

U.S. PATENT DOCUMENTS

| | | | | |
|---|---|---|---|---|
| Re. 31,371 | * | 9/1983 | Kuroishi et al. | 399/237 X |
| 3,972,305 | * | 8/1976 | Sato | 399/241 X |
| 4,035,071 | * | 7/1977 | Miyakawa et al. | 399/237 X |
| 4,044,718 | * | 8/1977 | Blake et al. | 399/241 |
| 5,023,665 | * | 6/1991 | Gundlach | 399/249 |
| 5,622,805 | | 4/1997 | Uehara et al. | 430/117 |

FOREIGN PATENT DOCUMENTS

| | | | |
|---|---|---|---|
| 58-215671 | | 12/1983 | (JP) . |
| 3-125171 | | 5/1991 | (JP) . |
| 5-333703 | | 12/1993 | (JP) . |
| 6-95514 | | 4/1994 | (JP) . |
| 6-295131 | | 10/1994 | (JP) . |
| 8-262877 | * | 10/1996 | (JP) . |
| 11-15285 | | 1/1999 | (JP) . |

OTHER PUBLICATIONS

Tadamitsu Uchiyama, Imaging Properties of Mist Development, Electrophotography, vol. 16, No. 2 (1977), pp. 21–26.

* cited by examiner

*Primary Examiner*—Sophia S. Chen
(74) *Attorney, Agent, or Firm*—Sughrue, Mion, Zinn, Macpeak & Seas, PLLC

(57) ABSTRACT

When developing an electrostatic latent image on an electrostatic latent image support by use of mist-like charged particles, a developing electrode is provided at a space from the electrostatic latent image support to extend substantially in parallel to the surface of the electrostatic latent image support on which the electrostatic latent image is formed. A gap control member is provided on the perimeter of the developing electrode to extend toward the surface of the electrostatic latent image support from the periphery of the developing electrode so that the space between the gap control member and the surface of the electrostatic latent image support is smaller than the space between the developing electrode and the surface of the electrostatic latent image support. Thus a developing space defined by the electrostatic latent image support, the developing electrode and the gap control member is formed. Mist-like charged particles are introduced into the developing space while applying an electric voltage to the developing electrode to form an electric field between the electrostatic latent image support and the developing electrode and moving the electrostatic latent image support and the developing space relative to each other.

26 Claims, 5 Drawing Sheets

IMAGE FORMING METHOD AND APPARATUS USING CHARGED PARTICLES

BACKGROUND OF THE INVENTION

1. Field of the Invention

This invention relates to an image forming method and an image forming apparatus such as a printer, a facsimile, a copier and the like, and more particularly to a method of and an apparatus for forming a visible image by developing an electrostatic latent image, formed on an photoconductor, an insulator member, a ferroelectric member or the like by electrophotography, electrostatic recording, ion flow method and the like, by causing liquid or solid charged particles to adhere to the electrostatic latent image.

2. Description of the Related Art

As a system for developing an electrostatic latent image formed on an electrostatic latent image support such as an electrophotography photoconductor, an electrostatic recording material, an insulator member, a ferroelectric member or the like, there have been known a dry development system using powder toner comprising coloring pigment included in solid fine particles and a wet development system using liquid toner comprising coloring pigment dispersed in insulating liquid. In the wet development system, since the coloring pigment is dispersed in liquid, the particle size of the toner can be small, which makes the wet developing system suitable for obtaining high resolution images. However use of combustible or volatile organic solvent has limited application of the wet development system, and recently the wet development system is hardly used.

In contrast, the dry development system is substantially larger in the particle size of the toner as compared with the liquid toner and the resolution and the quality of the image obtained are relatively low. However the dry development system is advantageous in that the use of dry toner facilitates handling the toner and miniaturization of the apparatus. Accordingly, the dry development system now prevails over the wet development system. Recently there are demands for image forming apparatuses which use the dry development system and yet are better in image quality and resolution. In order to meet such demands, it is necessary to further reduce the particle size of the toner, for instance, to not larger than 5 $\mu$m.

In copiers and printers of electrophotography systems using liquid toner or solid toner, toner which has been applied to the electrostatic latent image support in development but does not contribute to forming an image is sometimes recovered and reused. (Such toner will be referred to as "non-used toner", hereinbelow.) However, since such non-toner constantly deteriorates in its characteristic due to reduction in density of the pigment and/or fluctuation in its toner/carrier ratio, only a part of the non-used toner has been reused. Further since a part of the toner is dispersed outside the apparatus, the non-used toner is not all recovered.

As another system for developing an electrostatic latent image on an electrostatic latent image support, there has been known a so-called mist development system in which atomized ink is dispersed in air like mist and is charged to form charged ink droplets or charged ink particles (referred to as "charged mist", hereinbelow), and then the charged mist is supplied to a developing space so that the charged mist adheres to the electrostatic latent image to develop it. Examples of the mist development system are disclosed, for instance, in Japanese Unexamined Patent Publication Nos. 58(1983)-215671, 3(1991)-125171, 5(1993)-333703, and 6(1994)-95514, and "Electrophotography", vol. 16, No. 2, 1977, pp. 21 to 26. Further there have been known non-contact development systems where ink in the form of droplets is blown through a slit over the electrostatic latent image or, as disclosed in Japanese Unexamined Patent Publication No. 6 (1994)-295131, ink in the form of droplets held on a roller is blown onto the electrostatic latent image.

The charged mist can adhere to the non-image area, highlight area, or low-density area of the electrostatic latent image, or the latent image support outside the electrostatic latent image, which result in so-called fog. In order to prevent this, there has been known a system in which air free from the charged mist is flowed between the electrostatic latent image and the charged mist. Further there has been known a system in which an electrode biased to the same polarity as the charged mist is disposed to be opposed to the electrostatic latent image support with the charged mist intervening therebetween so that the charged mist is urged toward the electrostatic latent image and adhesion of the charged mist to the electrostatic latent image is promoted, thereby shortening the developing time.

The mist development system is advantageous over the conventional ink jet system which directly records an image on a printing paper in that improvement of image quality is facilitated since it uses finer ink droplets of the mist and that it requires no nozzle head which is required in the ink jet system and is formed by micro-machining technologies. Further by the mist development system, a development apparatus which can develop a wide area at one time and accordingly can form an image at high speed can be easily formed.

However it is generally difficult to supply the charged mist uniformly in the developing space, especially when the developing space is narrow, by supplying the charged mist to the developing space by use of an air fan or the like, and unevenness in density of the developed image due to fluctuation in concentration of the charged mist and/or unevenness in flow of the charged mist in the developing space is apt to occur. This is more serious when the distance between the electrostatic latent image support and the developing space and/or the cross-sectional dimensions of the flow passage of the charged mist in the developing space are not uniform, and greatly deteriorates the quality of the image. When the charged mist is supplied to the entire area of the developing space opposed to the electrostatic latent image support, charged particles can adhere to the non-image area, highlight area, or low-density area of the electrostatic latent image, or the latent image support outside the electrostatic latent image, which can result in fog.

SUMMARY OF THE INVENTION

In view of the foregoing observations and description, the primary object of the present invention is to provide an image forming method and an image forming apparatus using a mist d evelopment system which can develop an image which is free from fog or unevenness in density and is excellent in gradation and/or granularity.

In accordance with a first aspect of the present invention, there is provided an image forming method of developing an electrostatic latent image on an electrostatic latent image support by use of mist-like charged particles and thereby making visible the electrostatic latent image, the method comprising the steps of providing a developing electrode at a space from the electrostatic latent image support to extend substantially in parallel to the surface of the electrostatic latent image support on which the electrostatic latent image is formed, providing a gap control member on at least a part of the perimeter of the developing electrode to extend toward the surface of the electrostatic latent image support from the periphery of the developing electrode so that the space between the gap control member and the surface of the electrostatic latent image support is smaller than the space between the developing electrode and the surface of the electrostatic latent image support, thereby forming a developing space defined by the electrostatic latent image support, the developing electrode and the gap control member, and introducing mist-like charged particles into the developing space while applying an electric voltage to the developing electrode to form an electric field between the electrostatic latent image support and the developing electrode and moving the electrostatic latent image support and the developing space relative to each other.

It is preferred that the image forming method in accordance with the first aspect of the present invention further comprises the steps of introducing the mist-like charged particles into the developing space through a mist supply port provided on the developing electrode, providing a deflector plate at the mist supply port to deflect the mist-like charged particles to flow in a direction substantially parallel to the developing electrode, and making the pressure in the developing space lower than the outside of the developing space so that gas such as air flows into the developing space from the outside of the developing space through the gap between the electrostatic latent image support and the gap control member, thereby forming a flow of the gas which flows toward the mist supply port near the electrostatic latent image and forming a flow of the mist-like charged particles near the developing electrode.

In accordance with a second aspect of the present invention, there is provided an image forming apparatus for developing an electrostatic latent image on an electrostatic latent image support by use of mist-like charged particles and thereby making visible the electrostatic latent image, the apparatus comprising a developing electrode provided at a space from the electrostatic latent image support to extend substantially in parallel to the surface of the electrostatic latent image support on which the electrostatic latent image is formed, a gap control member provided on at least a part of the perimeter of the developing electrode to extend toward the surface of the electrostatic latent image support from the periphery of the developing electrode so that the space between the gap control member and the surface of the electrostatic latent image support is smaller than the space between the developing electrode and the surface of the electrostatic latent image support, thereby forming a developing space defined by the electrostatic latent image support, the developing electrode and the gap control member, a mist supply means for introducing mist-like charged particles into the developing space, an electric voltage application means which applies an electric voltage to the developing electrode to form an electric field between the electrostatic latent image support and the developing electrode, and a drive means for moving the electrostatic latent image support and the developing space relative to each other.

It is preferred that the space between the surface of the electrostatic latent image support and the developing electrode be not larger than 10 mm (more preferably not larger than 1 mm) and be substantially uniform.

Further it is preferred that at least one mist supply port through which the mist-like charged particles are introduced into the developing space be provided on the developing electrode, and at least one mist suction port for sucking "non-used mist-like charged particles" in the developing space be provided on the developing electrode.

Further it is preferred that a deflector plate for deflecting the mist-like charged particles to flow in a direction substantially parallel to the developing electrode be provided at the mist supply port.

Further it is preferred that a suction means makes the pressure in the developing space lower than the outside of the developing space so that gas such as air flows into the developing space from the outside of the developing space through the gap between the electrostatic latent image support and the gap control member, thereby forming a flow of the gas, which flows toward the mist supply port, near the electrostatic latent image and forming a flow of the mist-like charged particles near the developing electrode.

The gap control member may be formed integrally with the developing electrode and is preferably formed of a conductive material. Further it is preferred that the gap control means be provided with a bias voltage application means for applying to the gap control member a bias voltage in the same polarity as the electric voltage applied to the developing electrode.

Further, the deflector plate be formed of a conductive material, and be provided with a bias voltage application means for applying to the deflector plate a bias voltage in the same polarity as the electric voltage applied to the developing electrode.

Further the image forming apparatus in accordance with the second aspect of the present invention may be provided with a recovery means for recovering non-used mist-like charged particles and a mist regenerating means for regenerating the recovered mist-like charged particles.

It is further preferred that fluctuation in the space between the electrostatic latent image support and the developing electrode be within ±15%.

The term "mist-like charged particles" should be broadly interpreted to include charged liquid particles dispersed in gas and charged solid particles dispersed in gas.

In the image forming method in accordance with the first aspect of the present invention and the image forming apparatus in accordance with the second aspect of the present invention, gas (e.g., air) outside the developing space flows into the developing space through the space between the electrostatic latent image support and the gap control member as an excellently shaped optimal laminar flow, and a so-called gas barrier is formed. The mist-like charged particles flow in the developing space along the gas barrier and cannot pass the gas barrier toward the electrostatic latent image support without force of the electric field formed between the electrostatic latent image support and the developing electrode. Since the gas barrier is an excellently shaped laminar flow, the mist-like charged particles flow in the developing space with less fluctuation in density and less unevenness in flow, and the charged particles adhere to the electrostatic latent image in an amount precisely proportional to charges of the electrostatic latent image, whereby an image which is excellent in gradation can be obtained without unevenness in density.

Further since the mist-like charged particles flow along the gas barrier, the charged particles do not travel toward the electrostatic latent image in places where an electric field toward the electrostatic latent image is not formed and accordingly do not adhere to the non-image part of the electrostatic latent image, whereby fog or the like of the image can be avoided and at the same time, unnecessary scattering of the charged particles can be suppressed and vain consumption of the ink can be suppressed.

When the developing electrode is provided with at least one charged mist supply port and at least one charged mist suction port and the gas in the developing space is sucked from the charged mist suction port to make the pressure in the developing space lower than that of the outside, a more properly shaped gas barrier can be formed and the gradation and the granularity of the image can be further improved.

When a deflector member is provided at the charged mist supply port to deflect the mist-like charged particles to flow substantially in parallel to the developing electrode, the charged mist travels toward the charged mist suction port through the developing space between the electrostatic latent image support and the developing electrode substantially uniformly spaced from the support, while fresh air (or other gas) flowing into the developing space through the gap between the gap control member and the electrostatic latent image support travels toward the charged mist suction port. At this time, the fresh air flows near the electrostatic latent image support and the mist-like charged particles flows near the developing electrode. Accordingly, the mist-like charged particles are prevented from traveling toward the flow of the fresh air unless urged by the electric field formed between the developing electrode and the electrostatic latent image, whereby fog of the image due to adherence of the charged particles to the non-image part of the electrostatic latent image support can be suppressed.

Since the developing electrode is at a substantially uniform space from the electrostatic latent image support, the electric field formed therebetween faithfully reflects the electrostatic latent image, and accordingly, the developed image can faithfully reflect the electrostatic latent image and can be of high quality. When the space between the electrostatic latent image support and the developing electrode is not larger than 10 mm, preferably not larger than 1 mm, the electric field formed between the electrostatic latent image support and the developing electrode can be strong and the distance which the charged particles travel to adhere to the electrostatic latent image can be short, whereby the charged particles travels at a high speed and the development can be effected at a high speed.

In accordance with a third aspect of the present invention, there is provided an image forming method of developing an electrostatic latent image on an electrostatic latent image support by use of mist-like charged particles and thereby making visible the electrostatic latent image, the method comprising the steps of providing a mist supply passage which has an opening in a position opposed to the electrostatic latent image support, forming a laminar flow of mist-like charged particles in the mist supply passage, forming a laminar flow of gas such as air free from the mist-like charged particles between the laminar flow of the mist-like charged particles and the inner surface of the mist supply passage at least on the side nearer to the electrostatic latent image support at least at a part of the mist supply passage near the opening, providing a first bias electrode near the opening of the mist supply passage, providing a second bias electrode on the inner surface of the mist supply passage opposite to the opening, and applying electric potentials to the first and second bias electrodes so that an electric field is formed in a direction perpendicular to the laminar flow of the mist-like charged particles and the mist-like charged particles are moved by the electric field toward the electrostatic latent image support passing through the laminar flow of the gas and the opening of the mist supply passage to adhere to the electrostatic latent image support and develop the electrostatic latent image.

For example, the laminar flow of air can be formed by providing an air passage along the inner surface of the mist supply passage at least on the side nearer to the electrostatic latent image support and making the pressure in the mist supply passage lower than the outside of the mist supply passage so that gas such as air flows into the mist supply passage from the outside of the mist supply passage through the air passage.

In this case, it is preferred that two air passages are formed along the inner surface of the mist supply passage on the side nearer to the electrostatic latent image support and the side remote from the same so that the laminar flow of the mist-like charged particles is sandwiched between laminar flows of air formed on the side nearer to the electrostatic latent image support and the side remote from the same.

The laminar flow of the gas may be formed irrespective of whether the electric field is formed by the first and second bias electrodes and the electrostatic latent image, that is, irrespective of whether development is to be effected.

In accordance with a fourth aspect of the present invention, there is provided an image forming apparatus for developing an electrostatic latent image on an electrostatic latent image support by use of mist-like charged particles and thereby making visible the electrostatic latent image, the apparatus comprising a mist supply passage which has an opening in a position opposed to the electrostatic latent image support, a means for forming a laminar flow of mist-like charged particles in the mist supply passage, and a means for forming a laminar flow of gas such as air free from the mist-like charged particles between the laminar flow of the mist-like charged particles and the inner surface of the mist supply passage at least on the side nearer to the electrostatic latent image support along at least a part of the mist supply passage near the opening, wherein the mist-like charged particles are moved toward the electrostatic latent image support passing through the laminar flow of the gas and the opening of the mist supply passage to adhere to the electrostatic latent image support and develop the electrostatic latent image.

For example, the laminar flow of air can be formed by providing an air passage along the inner surface of the mist supply passage at least on the side nearer to the electrostatic latent image support and making the pressure in the mist supply passage lower than the outside of the mist supply passage so that gas such as air flows into the mist supply passage from the outside of the mist supply passage through the air passage.

In this case, it is preferred that two air passages are formed along the inner surface of the mist supply passage on the side nearer to the electrostatic latent image support and the side remote from the same so that the laminar flow of the mist-like charged particles is sandwiched between laminar flows of air formed on the side nearer to the electrostatic latent image support and the side remote from the same.

It is preferred that the image forming apparatus be provided with an electric field forming means which forms an electric field in a direction perpendicular to the laminar flow of the mist-like charged particles so that the mist-like charged particles are urged toward the electrostatic latent image support passing through the laminar flow of the gas and the opening of the mist supply passage by the electric field.

For example, the electric field forming means may comprise a first bias electrode provided near the opening of the mist supply passage between the electrostatic latent image support and the laminar flow of the gas free from the mist-like charged particles formed on the side of the laminar flow of the mist-like charged particles nearer to the electrostatic latent image support, and a second bias electrode which is provided opposed to the first bias electrode with the laminar flow of the mist-like charged particles intervening therebetween.

The first bias electrode may be a slit electrode having a plurality of slits.

The space between the electrostatic latent image support and the opening is preferably not larger than 10 mm, and more preferably not larger than 1 mm.

It is preferred that the image forming means be further provided with a recovery means for recovering the "non-used mist-like charged particles" and a mist-like charged particle regeneration means which regenerates mist-like charged particles from the recovered charged particles.

For example, the first bias electrode is provided in an area surrounding the opening of the mist supply passage, and may form at least a part of the wall of the mist supply passage. Otherwise, the first bias electrode may be provided separately from the wall of the mist supply passage in an area surrounding the opening. In this case, the first bias electrode may be either in contact with the wall of the mist supply passage or at a space from the wall.

The second bias electrode is provided in an area opposed to the opening of the mist supply passage, and may form at least a part of the wall of the mist supply passage. Otherwise, the second bias electrode may be provided separately from the wall of the mist supply passage in an area opposed to the opening. In this case, the second bias electrode may be either in contact with the wall of the mist supply passage or at a space from the wall.

In the image forming method in accordance with the third aspect of the present invention and the image forming apparatus in accordance with the fourth aspect of the present invention, a laminar flow of mist-like charged particles is formed in the mist supply passage, and a laminar flow of gas free from the mist-like charged particles is formed between the laminar flow of the mist-like charged particles and the inner surface of the mist supply passage at least on the side nearer to the electrostatic latent image support along at least a part of the mist supply passage near the opening. Accordingly, the mist-like charged particles flow to the opening of the mist supply passage without adhering to the inner surface of the mist supply passage at least on the side nearer to the electrostatic latent image support.

Further, the mist-like charged particles flow in the developing space along the gas barrier (the laminar flow of the gas) and cannot pass the gas barrier toward the electrostatic latent image support without force of the electric field formed between the electrostatic latent image support and the developing electrode. Since the gas barrier is an excellently shaped laminar flow, the mist-like charged particles flow in the developing space with less fluctuation in density and less unevenness in flow, the charged particles adhere to the electrostatic latent image support in an amount precisely proportional to charges of the electrostatic latent image, whereby an image which is excellent in both gradation and granularity can be obtained without unevenness in density.

Further since the mist-like charged particles flow along the gas barrier, the charged particles do not travel toward the electrostatic latent image support in places where an electric field toward the electrostatic latent image support is not formed and accordingly do not adhere to the non-image part of the electrostatic latent image support, whereby fog or the like of the image can be avoided and at the same time, unnecessary scattering of the charged particles can be suppressed and vain consumption of the ink can be suppressed.

When the first and second bias electrodes are applied with bias potentials in the same polarity as the charged mist, a strong electric field is directed toward the electrostatic latent image near the opening, and the charged particles adhere to the electrostatic latent image at a high speed, whereby the developing speed can be increased. For the non-image part, no electric field is formed in the mist supply passage so long as the first and second bias electrodes are held as the same potential, accordingly, the charged particles cannot move toward the electrostatic latent image support to adhere thereto, whereby fog of image can be prevented.

When two air passages are formed along the inner surface of the mist supply passage on the side nearer to the electrostatic latent image support and the side remote from the same so that the laminar flow of the mist-like charged particles is sandwiched between laminar flows of the gas formed on the side nearer to the electrostatic latent image and the side remote from the same, the mist-like charged particles flow in the developing space with less fluctuation in density and less unevenness in flow, the charged particles adhere to the electrostatic latent image in an amount precisely proportional to charges of the electrostatic latent image, whereby an image which is excellent in both gradation and granularity can. be obtained without unevenness in density.

When the space between the electrostatic latent image support and the opening of the mist supply passage is not larger than 10 mm, preferably not larger than 1 mm, a strong electric field is formed, whereby the charged particles travels at a high speed and the development can be proceeded at a high speed.

DESCRIPTION OF THE PREFERRED EMBODIMENTS

Figure 1:
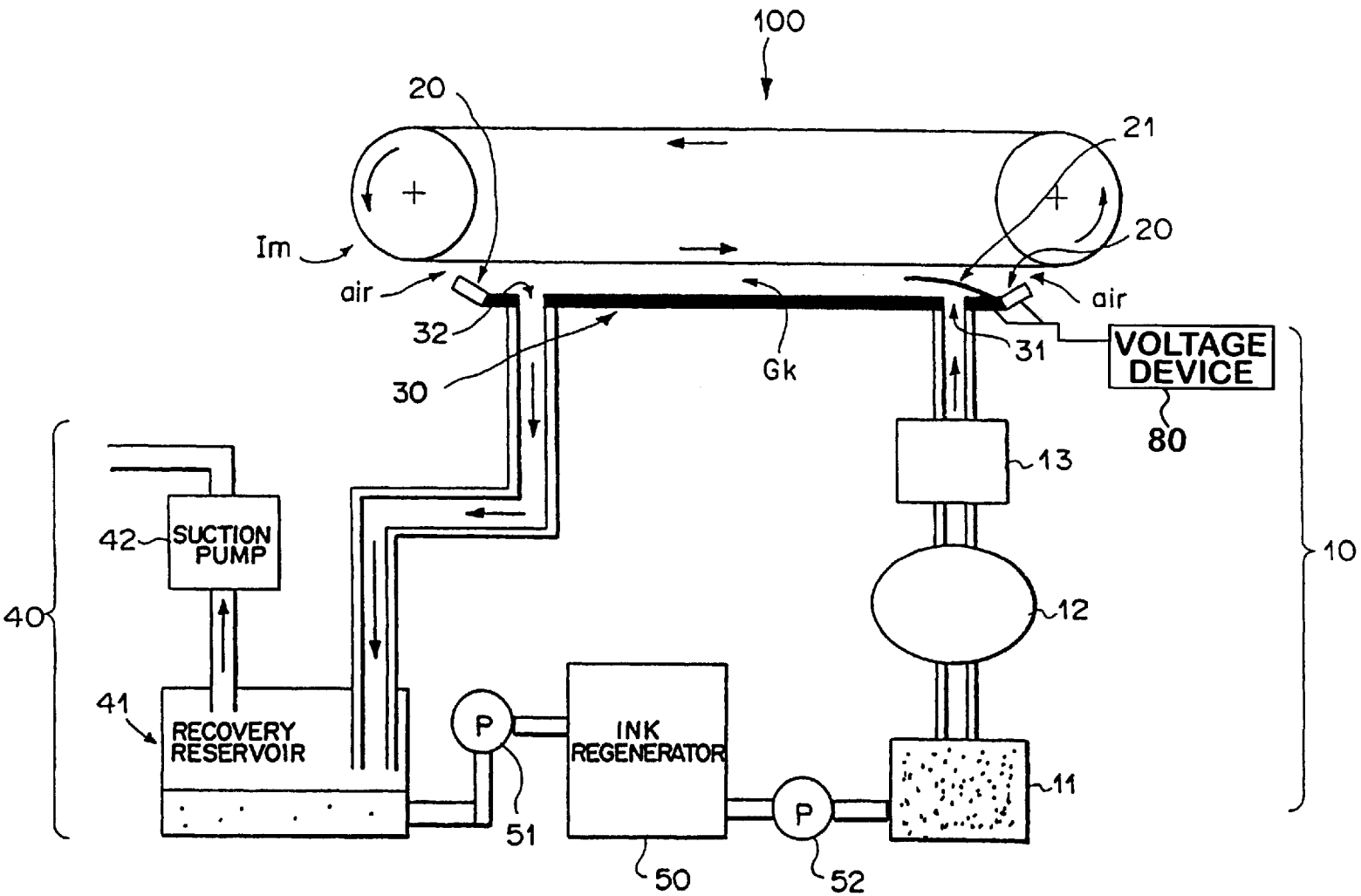
FIG. 1 is a schematic view showing an image forming apparatus in accordance with a first embodiment of the present invention.

In FIG. 1, an image forming apparatus in accordance with a first embodiment of the present invention comprises an electrostatic latent image support 100 in the form of an endless belt which holds an electrostatic latent image Im on the surface thereof and is moved in a direction shown by arrows, a developing electrode 30 which is opposed to the electrostatic latent image support 100 at a predetermined space therefrom, and a gap control member 20 provided on the perimeter of the developing electrode 30 to extend toward the surface of the electrostatic latent image support 100 so that the space between the gap control member and the surface of the electrostatic latent image support 100 is smaller than the space between the developing electrode 30 and the surface of the electrostatic latent image support 100. A developing space Gk is defined by the electrostatic latent image support 100, the developing electrode 30 and the gap control member 20. The image forming apparatus of this embodiment further comprises a charged mist supply unit 10 which supplies charged mist (mist-like charged particles) to the developing space Gk, a charged mist recovery unit 40 which recovers and liquefies "non-used charged mist", that is, the part of the charged mist which was supplied to the developing space Gk from the charged mist supply unit 10 but did not contribute to development of the electrostatic latent image Im, an ink regeneration unit 50 which regenerates ink stock solution from the liquefied charged mist transferred from the charged mist recovery unit 40 by a first pump 51, and a second pump 52 which transfers regenerated ink stock solution from the ink regeneration unit 50 to the charged mist supply unit 10.

A charged mist supply port 31 connected to the charged mist supply unit 10 opens in the developing electrode 30 to the developing space Gk, and a charged mist suction port 32 connected to the charged mist recovery unit 40 opens in the developing electrode 30 to the developing space Gk. Further the developing electrode 30 is provided with a deflector plate 21 at the charged mist supply port 31 to deflect the charged mist flow along the developing electrode 30.

The charged mist supply unit 10 comprises a mist generator 11 comprising an ultrasonic piezoelectric atomizer which generates ink mist dispersed in air, a fan for transferring the mist, and the like, a charger 12 which charges the mist by corona charging or the like, and an electric field filter 13 for removing from the charged mist charged particles which are larger than a predetermined value in mass and higher than a predetermined value in charge.

The charged mist recovery unit 40 comprises a recovery reservoir 41, and a suction pump 42 which is disposed downstream of the reservoir 41 and sucks the charged mist in the developing space Gk into the recovery reservoir 41 through the charged mist suction port 32.

The ink regeneration unit 50 transfers the charged mist in the recovery reservoir 41 to an ink regeneration reservoir built therein through a filter, adjusts the composition and the like of the charged mist to make ink stock solution and then transfers the ink stock solution thus made to the mist generator 11. The ink regeneration unit 50 comprises sensors and instruments for adding pigment, dye, ink medium, additives and the like and adjusting the composition while monitoring the composition of the ink.

Operation of the image forming apparatus of this embodiment will be described hereinbelow.

The ink stock solution stored in the ink regeneration unit 50 is transferred to the mist generator 11 by the second pump 52 and atomized by the mist generator 11. The atomized ink is dispersed in air by the fan in the mist generator 11 to form mist. Then the mist is transferred to the charger 12 and charged by the charger 12 to form charged mist. The charged mist is transferred to the electric field filter 13.

The electric field filter 13 traps charged particles of the charged mist which are larger than a predetermined value in mass and higher than a predetermined value in charge and only charged particles having mass in a predetermined range and charge in a predetermined range can pass through the electric field filter 13.

The charged mist consisting of charged particles in the predetermined mass range and in the predetermined charge range flows into the developing space Gk through the charged mist supply port 31. The flow of the charged mist is deflected by the deflector plate 21 substantially in parallel to the developing electrode 30 and the charged mist travels toward the charged mist suction port 32 through the developing space Gk between the electrostatic latent image support 100 and the developing electrode 30 substantially uniformly spaced from the support 100.

The developing space Gk is held in a negative pressure to that of the atmosphere by suctioning the developing space through the charged mist suction port 32 and accordingly fresh air (or may be other gas) flows into the developing space through the gap between the gap control member 20 and the electrostatic latent image support 100, whereby an air barrier is formed in the gap between the gap control member 20 and the electrostatic latent image support 100, which prevents the charged mist from flowing outside.

The fresh air flowing into the developing space Gk through the gap between the gap control member 20 and the electrostatic latent image support 100 travels toward the charged mist suction port 32. At this time, the fresh air flows near the electrostatic latent image support 100 and the charged mist flows near the developing electrode 30.

In the conventional electrophotographic copiers or printers, the toner is usually stocked in the machine and supply of the toner to the latent image is stopped when development of the electrostatic latent image is not effected. In contrast, in the case of the image forming apparatus of this embodiment, the charged mist is not generated until development of the electrostatic latent image comes to be actually effected.

That is, the image forming apparatus of this embodiment starts to operate the mist generator 11 and the charger 12 upon receipt of a signal instructing the image forming apparatus to form an image. Development of the electrostatic latent image is not permitted until the concentration of the charged particles in the developing space Gk is increased after beginning of supply of the charged mist to the developing space Gk and that the concentration of charged particles has been stabilized to a predetermined value is confirmed.

Whether the ink stock solution is sufficient, whether the atomized mist is properly charged, and whether the concentration of the charged particles in the developing space Gk has been stabilized to the predetermined value are checked by sensors and when these conditions are not all satisfied, the alarm is given.

Whether the ink stock solution is sufficient can be detected by the use of a float sensor, and the concentration of the charged particles in the developing space Gk can be detected by the use of a photoelectric sensor. Whether the atomized mist is properly charged can be detected, for instance, indirectly by measuring an electric current flowing through the charger, or directly by measuring the amount of fine particles adhering in a unit time to an electrode which is provided near the developing space Gk and is applied with an electric field, or by forming a monitor electrostatic latent image on the electrostatic latent image support and measuring the concentration of the charged particles of the developed monitor latent image.

Development of the electrostatic latent image Im with the charged mist will be described, hereinbelow.

Figure 2:
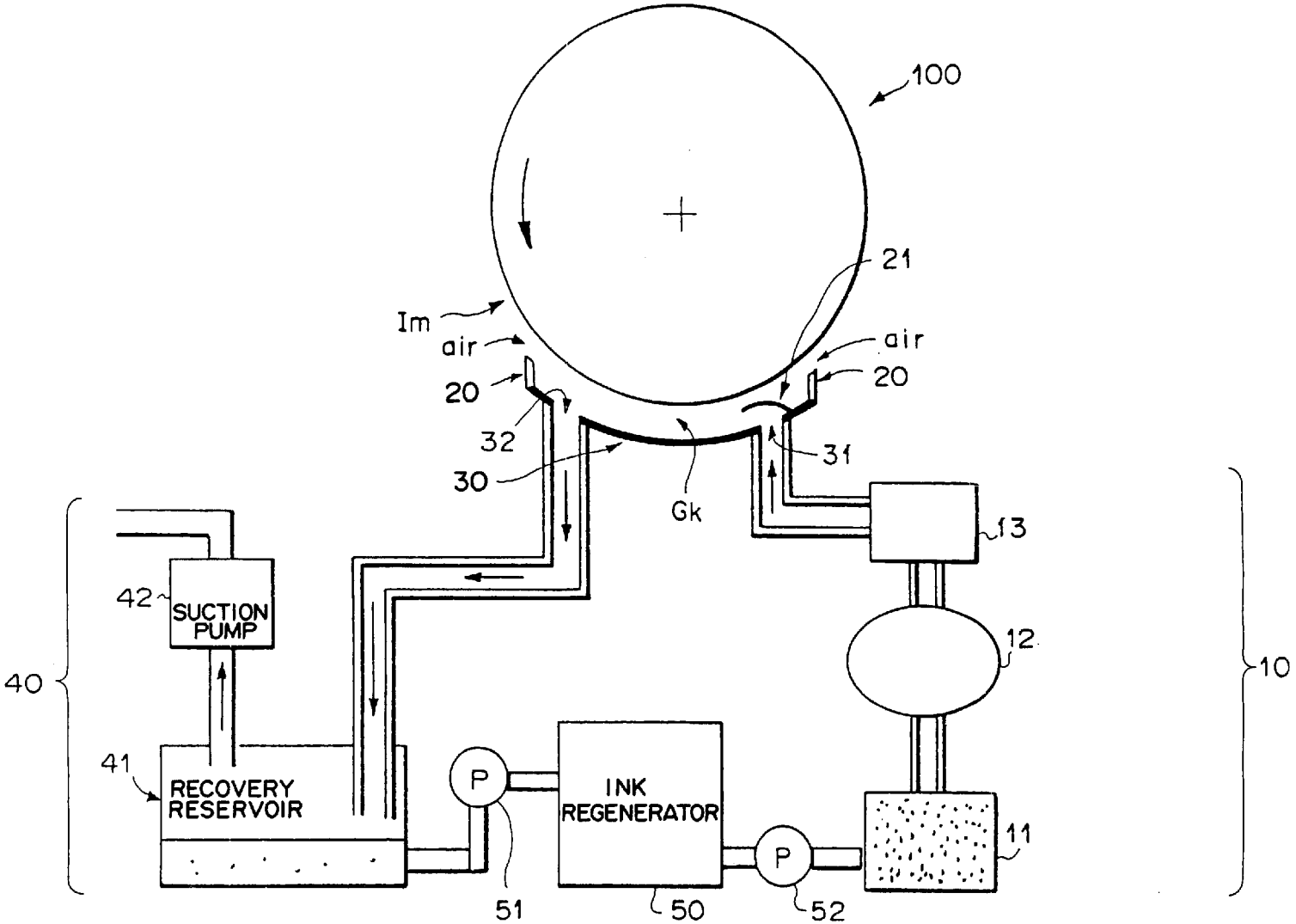
FIG. 2 is a schematic view showing a modification of the image forming apparatus of the first embodiment.

An electrostatic latent image Im is formed on the electrostatic latent image support 100 in the form of an endless belt by an electrostatic latent image forming means (not shown). The electrostatic latent image support 100 may comprise a belt of dielectric material provided with a conductive layer and an organic photo-conductive layer formed thereon. Further, the electrostatic latent image support 100 may be formed of an insulator material such as polyethylene terephthalate, tantalum oxide or the like, a ferroelectric or pyroelectric material such as polyvinylidene fluoride. Further in place of the endless belt-like electrostatic latent image support, a drum-like electrostatic latent image support may be employed as shown in FIG. 2. The drum-like electrostatic latent image support may comprise a drum-like base of aluminum or the like and a photo-conductive layer (e.g., of selenium, amorphous silicon or the like) formed on the drum-like base. The electrostatic latent image may be formed by various known manners. For example, it may be formed by optical recording using a laser, an LED array or the like when the electrostatic latent image support comprises a uniformly charged photo-conductive member, by an electrostatic recording using an electrostatic stylus, an ion-flow head or the like, or by a thermal recording when the electrostatic latent image support comprises an insulator member, a ferroelectric member or the like.

When the electrostatic latent image support 100 is moved to a position where the electrostatic latent image Im is opposed to the developing electrode 30 which is grounded or biased with a bias voltage, an electric field is formed between the support 100 and the developing electrode 30, and the electric field urges the charged mist toward the electrostatic latent image Im.

While the charged mist is moved toward the charged mist suction portion 32, the charged particles in the charged mist are attracted against the electrostatic latent image Im under the force of the electric field and adhere to the electrostatic latent image Im, whereby the electrostatic latent image Im is developed. This continues until the electrostatic latent image Im is moved outside the developing space Gk as the electrostatic latent image support 100 is moved in the direction indicated by the arrows in FIG. 1.

Since the developing electrode 30 is at a substantially uniform space from the electrostatic latent image support 100, the electric field formed therebetween faithfully reflects the electrostatic latent image Im, and accordingly, the developed image can faithfully reflect the electrostatic latent image Im and can be of high quality. When the space between the electrostatic latent image support 100 and the developing electrode 30 is not larger than 10 mm, preferably not larger than 1 mm, the electric field formed between the electrostatic latent image support 100 and the developing electrode 30 can be strong, whereby the charged particles travels at a high speed and the development can be effected at a high speed.

In the developing space Gk, the charged mist flows near the developing electrode 30 and the fresh air flowing into the developing space Gk through the space between the gap control member 20 and the electrostatic latent image support 100 flows near the electrostatic latent image support 100. Accordingly, the electrostatic latent image Im is developed by the charged particles which travel through the flow of fresh air under the force of the electric field and the flow of the charged mist is not brought into a direct contact with the electrostatic latent image Im, which prevents fog of the developed image. Further, the charged mist is prevented from leaking outside the developing space Gk through the gap between the gap control member 20 and the electrostatic latent image support 100 by the fresh air flowing into the developing space through the gap, whereby vain consumption of ink can be avoided.

Handling of the "non-used charged mist" which travels through the developing space Gk without contributing to development and is sucked into the charged suction port 32 will be described, hereinbelow.

The non-used charged mist is sucked by the suction pump 42 and introduced into the recovery reservoir 41 together with the air. The charged particles in the recovered charged mist impact against ink particles in ink stored in the reservoir 41 and agglomerate while the air is discharged to the atmosphere through a filter built in the pump 42. The ink held in the reservoir 41 is transferred to the ink regeneration unit 50 through a filter. Then the composition of the ink is adjusted by adding pigment or dye, ink medium, additives and the like. Thus the recovered ink is regenerated to ink stock solution and is transferred to the mist generator 11 again.

In the conventional electrophotographic copiers and printers using liquid toner or dry toner, only a part of the "non-used toner" has been reused as described above. In contrast, in the image forming apparatus of this embodiment, almost all the non-used charged particles an be reused without deteriorating characteristics of regenerated ink.

The bias voltage applied to the developing electrode 30 may be positive or negative DC bias, AC bias, or DC bias and AC bias superimposed one on another.

The charged mist may be charged either in positive or negative.

Though, in the embodiment described above, the charged mist and the air are flowed by the suction pump 42 provided downstream of the recovery reservoir 41 and the fan built in the mist generator 11, they may be flowed by pressurizing them from upstream.

Further, though the electrostatic latent image support 100 is in the form of an endless belt in the embodiment described above, the electrostatic latent image support may be in the form of a rotary drum as shown in FIG. 2.

The gap control member 20 may be formed integrally with the developing electrode 30. Further though the gap control member 20 may be formed of any suitable material, it is preferred that the gap control member 20 be formed of a conductive material and be held at the same potential as the developing electrode 30. In this case, even if the charged particles adhere to the gap control member 20, the electric field formed in the developing space cannot be disturbed.

Further, it is preferred that the deflector plate 21 provided at the charged mist supply port 31 be formed of a conductive material. Also in this case, even if the charged particles adhere to the deflector plate 21, the electric field formed in the developing space cannot be disturbed.

Further, though, in the embodiment described above, the charged mist comprises charged liquid particles dispersed in air or gas, charged mist comprising charged solid particles dispersed in air or gas may be used.

As can be understood from the description above, in accordance with the image forming apparatus of the first embodiment, a high quality image excellent in gradation and granularity can be developed without fog or unevenness in density. Further, vain consumption of ink can be saved.

Figure 3:
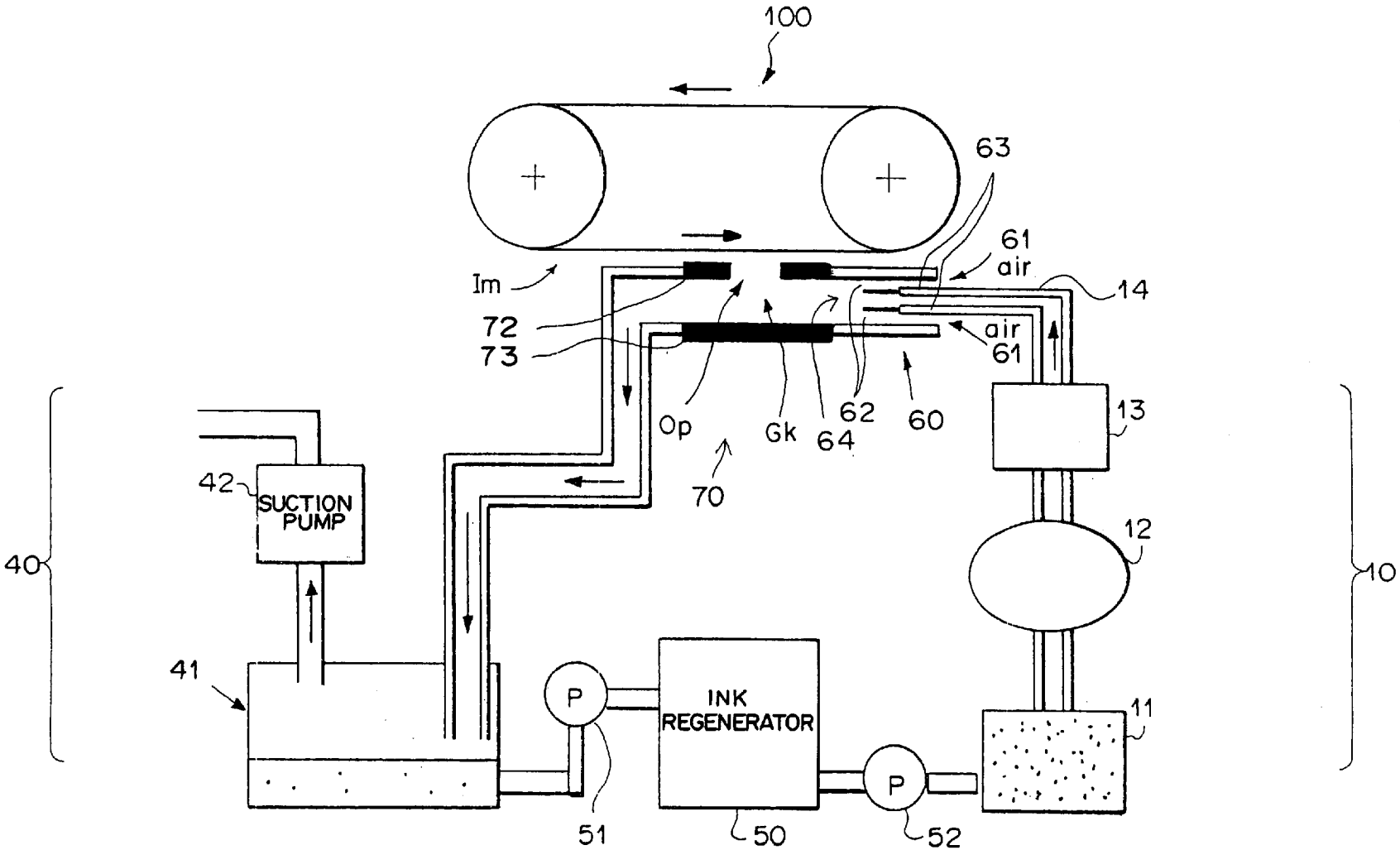
FIG. 3 is a schematic view showing an image forming apparatus in accordance with a second embodiment of the present invention.
Figure 4:
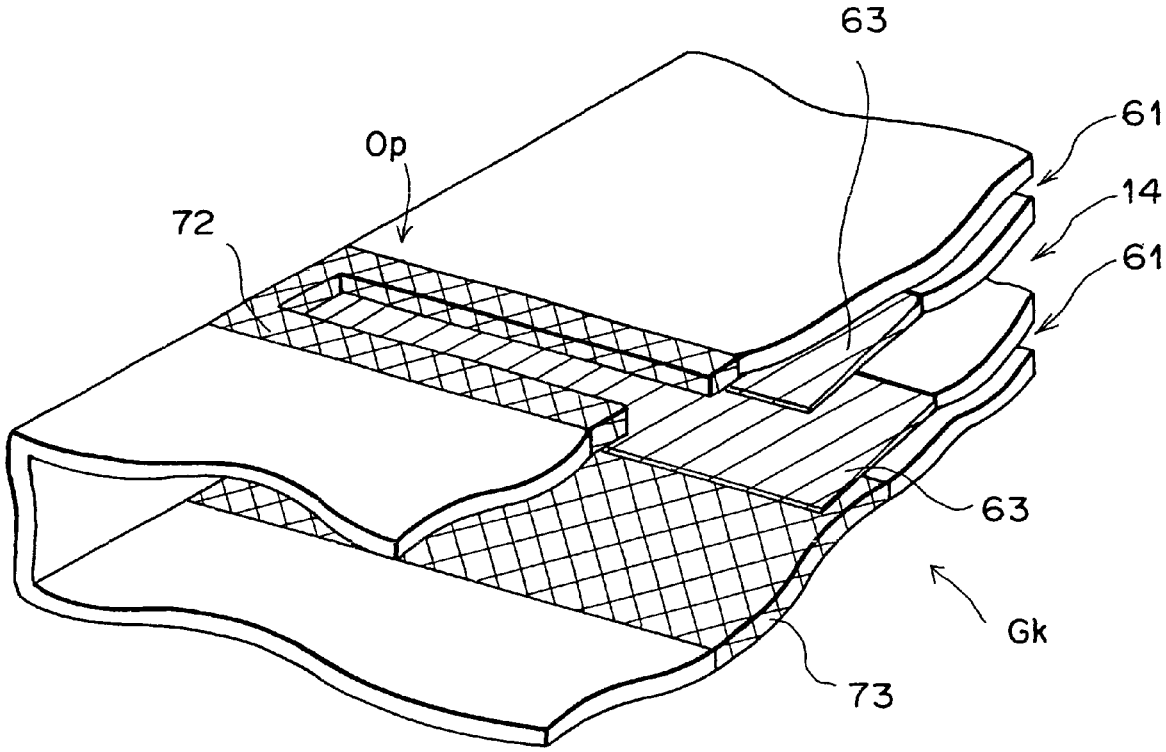
FIG. 4 is an enlarged perspective view partly cutaway showing the mist supply passage.

An image forming apparatus in accordance with a second embodiment of the present invention will be described with reference to FIGS. 3 and 4, hereinbelow. In FIGS. 3 and 4, the elements analogous to those shown in FIGS. 1 and 2 are given the same reference numerals and will not be described in detail here.

In FIG. 3, the image forming apparatus of this embodiment comprises a charged mist supply unit 10 which generates charged mist and supplies the charged mist to the developing space Gk by way of an air confinement unit 60 which sandwiches a laminar flow of the charged mist between upper and lower air layers, a development unit 70 which supplies the sandwiched laminar flow of the charged mist to the developing space Gk to develop the electrostatic latent image Im on the electrostatic latent image support 100, a charged mist recovery unit 40 which recovers and liquefies "non-used charged mist", that is, the part of the charged mist which was supplied to the developing space Gk from the charged mist supply unit 10 but did not contribute to development of the electrostatic latent image Im, and an ink regeneration unit 50 which regenerates ink stock solution from the liquefied charged mist transferred from the charged mist recovery unit 40.

The charged mist supply unit 10 comprises a mist generator 11 comprising an ultrasonic piezoelectric atomizer which generates ink mist dispersed in air, a fan for discharging the mist, and the like, a charger 12 which charges the mist by corona charging or the like, an electric field filter 13 for removing from the charged mist charged particles which are larger than a predetermined value in mass and higher than a predetermined value in charge and a charged mist supply pipe 14 for transferring the charged mist to the air confinement unit 60.

The development unit 70 basically comprises a rectangular chamber (development space Gk) as shown in FIG. 4 formed by upper and lower walls, a pair of side walls and upstream and downstream end walls. The charged mist supply pipe 14 is fitted in the upstream end of the development unit 70 with gaps 61 respectively formed between the upper surface of the charged mist supply pipe 14 and the lower surface of the upper wall of the development unit 70 and between the lower surface of the charged mist supply pipe 14 and the upper surface of the lower wall of the development unit 70. Upper and lower laminar flow forming plates 63 extend from the downstream end of the charged mist supply pipe 14.

The air confinement unit 60 is formed by the gaps 61, upper and lower air flow passages 62 which are formed by the upper and lower laminar flow forming plates 63 and the upper and lower walls of the development unit 70, and the upper and lower laminar flow forming plates 63.

The development unit 70 further comprises an opening Op which is formed in the upper wall of the chamber and surrounded by a first bias electrode 72 and a second bias electrode 73 provided on the lower wall of the chamber in a position opposed to the opening Op. The first and second bias electrodes 72 and 73 are charged in the same polarity as the charged mist.

The charged mist recovery unit 40 is connected to the downstream end of the chamber of the development unit 70 and comprises a recovery reservoir 41, and a suction pump 42 which is disposed downstream of the reservoir 41 and sucks the charged mist in the developing space Gk into the recovery reservoir 41.

The ink regeneration unit 50 transfers the charged mist in the recovery reservoir 41 to an ink regeneration reservoir built therein through a filter, adjusts the composition and the like of the charged mist to make ink stock solution and then transfers the ink stock solution thus made to the mist generator 11. The ink regeneration unit 50 comprises sensors and instruments for adding pigment, dye, ink medium, additives and the like and adjusting the composition while monitoring the composition of the ink.

Operation of the image forming apparatus of this embodiment will be described hereinbelow.

Forming a laminar flow of the charged mist in the developing space will be described first.

The ink stock solution stored in the ink regeneration unit 50 is transferred to the mist generator 11 and atomized by the mist generator 11. The atomized ink is dispersed in air by the fan in the mist generator 11 to form mist. Then the mist is transferred to the charger 12 and charged in positive or negative polarity by the charger 12 to form charged mist. The charged mist is transferred to the electric field filter 13. The electric field filter 13 traps charged particles of the charged mist which are larger than a predetermined value in mass and higher than a predetermined value in charge and only charged particles having mass in a predetermined range and charge in a predetermined range can pass through the electric field filter 13. The charged mist consisting of charged particles in the predetermined mass range and in the predetermined charge range flows into the developing space Gk through the charged mist supply pipe 14 under the force of the fan in the mist generator 11 and the suction pump 42. The charged mist supplied from the mist supply pipe 14 flows through a passage 64 between the laminar flow forming plates 63. The width of the passage 64, that is, the space dl between the upper and lower laminar flow forming plates 63, is set to satisfy a laminar flow forming condition $v1 \cdot d1/\eta 1 < 2300$ (v1 representing the flow velocity of the charged mist and $\eta 1$ representing the coefficient of viscosity of the same) so that the charged mist is supplied to the center of the developing space Gk as a laminar flow. Fresh air (or other gas) outside the developing space Gk flows into the developing space Gk through the upper and lower air flow passages 62 which are formed by the upper and lower laminar flow forming plates 63 and the upper and lower walls of the development unit 70. The width of each of the air flow passages 62, that is, the space d2 between the upper laminar flow forming plate 63 and the upper wall of the chamber or the between the lower laminar flow forming plate 63 and the lower wall of the chamber, is set to satisfy a laminar flow forming condition $v2 \cdot d2/\eta 2 < 2300$ (v2 representing the flow velocity of the fresh air and $\eta 2$ representing the coefficient of viscosity of the same), whereby fresh air flows as a pair of laminar flows near the upper and lower walls of the chamber with the laminar flow of the charged mist sandwiched therebetween. The dimensions of the developing space Gk is set so that the laminar flows of the fresh air and the laminar flow of the charged mist are the same in speed and accordingly these laminar flows are not disturbed and the fresh air and the charged mist are kept laminar flows. As a result, the charged mist is supplied as a laminar flow sandwiched between the laminar flows of fresh air. Accordingly, the charged mist is transferred to the opening op without adhering to the inner surface of the wall of the chamber.

In the conventional electrophotographic copiers or printers, the toner is usually stocked in the machine and supply of the toner to the latent image is stopped when development of the electrostatic latent image is not effected. In contrast, in the case of the image forming apparatus of this embodiment, the charged mist is not generated until development of the electrostatic latent image comes to be actually effected.

That is, the image forming apparatus of this embodiment starts to operate the mist generator 11 and the charger 12 upon receipt of a signal instructing the image forming apparatus to form an image. Development of the electrostatic latent image is not permitted until the concentration of the charged particles in the developing space Gk is increased after beginning of supply of the charged mist to the developing space Gk and that the concentration of charged particles has been stabilized to a predetermined value is confirmed.

Whether the ink stock solution is sufficient, whether the atomized mist is properly charged, and whether the concentration of the charged particles in the developing space Gk has been stabilized to the predetermined value are checked by sensors and when these conditions are not all satisfied, the alarm is given.

Whether the ink stock solution is sufficient can be detected by the use of a float sensor, and the concentration of the charged particles in the developing space Gk can be detected by the use of a photoelectric sensor. Whether the atomized mist is properly charged can be detected, for instance, indirectly by measuring an electric current flowing through the charger, or directly by measuring the amount of fine particles adhering in a unit time to an electrode which is provided near the developing space Gk and is applied with an electric field, or by forming a monitor electrostatic latent image on the electrostatic latent image support and measuring the optical density or mass of the adhered particles on the developed monitor latent image.

Development of the electrostatic latent image Im with the charged mist will be described, hereinbelow.

An electrostatic latent image Im is formed on the electrostatic latent image support 100 in the form of an endless belt by an electrostatic latent image forming means (not shown). The electrostatic latent image support 100 may comprise a belt of dielectric material provided with a conductive layer and an organic photo-conductive layer formed thereon. Further, the electrostatic latent image support 100 may be formed of an insulator material such as polyethylene terephthalate, tantalum oxide or the like, a ferroelectric or pyroelectric material such as polyvinylidene fluoride. Further in place of the endless belt-like electrostatic latent image support, a drum-like electrostatic latent image support may be employed. The drum-like electrostatic latent image support may comprise a drum-like base of aluminum or the like and a photo-conductive layer (e.g., of selenium, amorphous silicon or the like) formed on the drum-like base.

The electrostatic latent image may be formed by various known manners. For example, it may be formed by optical recording using a laser, an LED array or the like when the electrostatic latent image support comprises a uniformly charged photo-conductive member, by an electrostatic recording using an electrostatic stylus, an ion-flow head or the like, or by a thermal recording when the electrostatic latent image support comprises an insulator member, a ferroelectric member or the like.

The electrostatic latent image support 100 carrying thereon a positive or negative electrostatic latent image Im is moved in the direction indicated by arrows in FIG. 3 to bring the electrostatic latent image Im to the opening Op. At the portion of the developing space Gk upstream of the opening Op, the first and second bias electrodes 72 and 73 which are biased in the same polarity are opposed to each other and accordingly, no electric field is formed and accordingly, the charged mist travels neither toward the first bias electrode 72 nor the second bias electrode 73 and adheres neither to the first bias electrode 72 nor the second bias electrode 73. At the portion of the developing space Gk opposed to the opening Op, the first and second bias electrodes 72 and 73 are opposed to the electrostatic latent image Im on the electrostatic latent image support 100 through the opening Op, and accordingly an electric field is formed in the space defined by the electrostatic latent image Im and the first and second bias electrodes 72 and 73 according to the potential of the electrostatic latent image Im and the potentials of the first and second bias electrodes 72 and 73.

When the electrostatic latent image Im is in the opposite polarity to that of the charged mist, a strong electric field directed toward the electrostatic latent image Im is formed and the charged mist flowing sandwiched between the laminar air flows travels toward the electrostatic latent image Im at a high speed through the upper laminar air flow under the force of the electric field and adheres to the electrostatic latent image Im, thereby developing the electrostatic latent image Im. For the non-image part of the electrostatic latent image support 100 where no electrostatic latent image is formed, no electric field is formed in the mist supply passage when the first and second bias electrodes 72 and 73 are kept at the same potential, and accordingly, the charged mist flowing sandwiched between the laminar air flows cannot travel toward the electrostatic latent image Im at a high speed. Accordingly, the charged mist can be easily prevented from adhering to the non-image part of the support 100 by controlling the bias voltage applied to the bias electrodes 72 and 73.

In contrast, when the electrostatic latent image Im is in the same polarity as that of the charged mist, an electric field formed at the imaged portion is weak and an electric field formed at the non-image portion is strong. Accordingly, the charged mist adheres only to the non-image portion and the electrostatic latent image Im is developed in reversal.

Since the first and second bias electrodes 72 and 73 are charged in the same polarity as the charged mist, the charged mist is prevented from adhering to an unnecessary part of the developing space Gk. Further, since the charged mist flows confined by air flows and cannot directly contact with the electrostatic latent image Im, development of the electrostatic latent image Im is effected by only the charged mist which travels through the air flow and fog of the image can be prevented. Further since fresh air flows into the developing space Gk through the gaps 61, the charged mist cannot leak outside the developing space Gk through the gaps 61, whereby vain consumption of the ink stock solution can be saved.

Handling of the "non-used charged mist" which travels through the developing space Gk without contributing to development will be described, hereinbelow.

The non-used charged mist is sucked by the suction pump 42 and introduced into the recovery reservoir 41 together with the air. The charged particles in the recovered charged mist impact against liquid ink stored in the reservoir 41 and agglomerate while the air is discharged to the atmosphere through a filter built in the pump 42. The ink held in the reservoir 41 is transferred by the pump 51 to the ink regeneration unit 50 through a filter. Then the concentration and composition of the ink are adjusted and a part of the recovered ink is transferred to the mist generator 11 again.

In the conventional electrophotographic copiers and printers using liquid toner or dry toner, only a part of the "non-used toner" has been reused as described above. In contrast, in the image forming apparatus of this embodiment, almost all the non-used charged particles can be reused without deteriorating characteristics of regenerated ink.

Though, in the embodiment described, the first and second bias electrode 72 and 73 are formed integrally with the chamber forming the developing space Gk, they may be formed separately from the chamber. Further, the first bias electrode 72 may be a slit electrode having a plurality of slits.

The bias voltages applied to the first and second bias electrodes 72 and 73 need not be at the same potential as the charged mist so long as they are in the same polarity as the charged mist. Further the bias voltages may be of DC bias and AC bias superimposed one on another.

Though, in the embodiment described above, the charged mist and the air are flowed by the suction pump 42 provided downstream of the recovery reservoir 41 and the fan built in the mist generator 11, they may be flowed by pressurizing them from upstream.

The electrostatic latent image support 100 may be moved either in the same direction as the direction of flow of the charged mist and the fresh air or in the direction reverse to the same.

Figure 5:
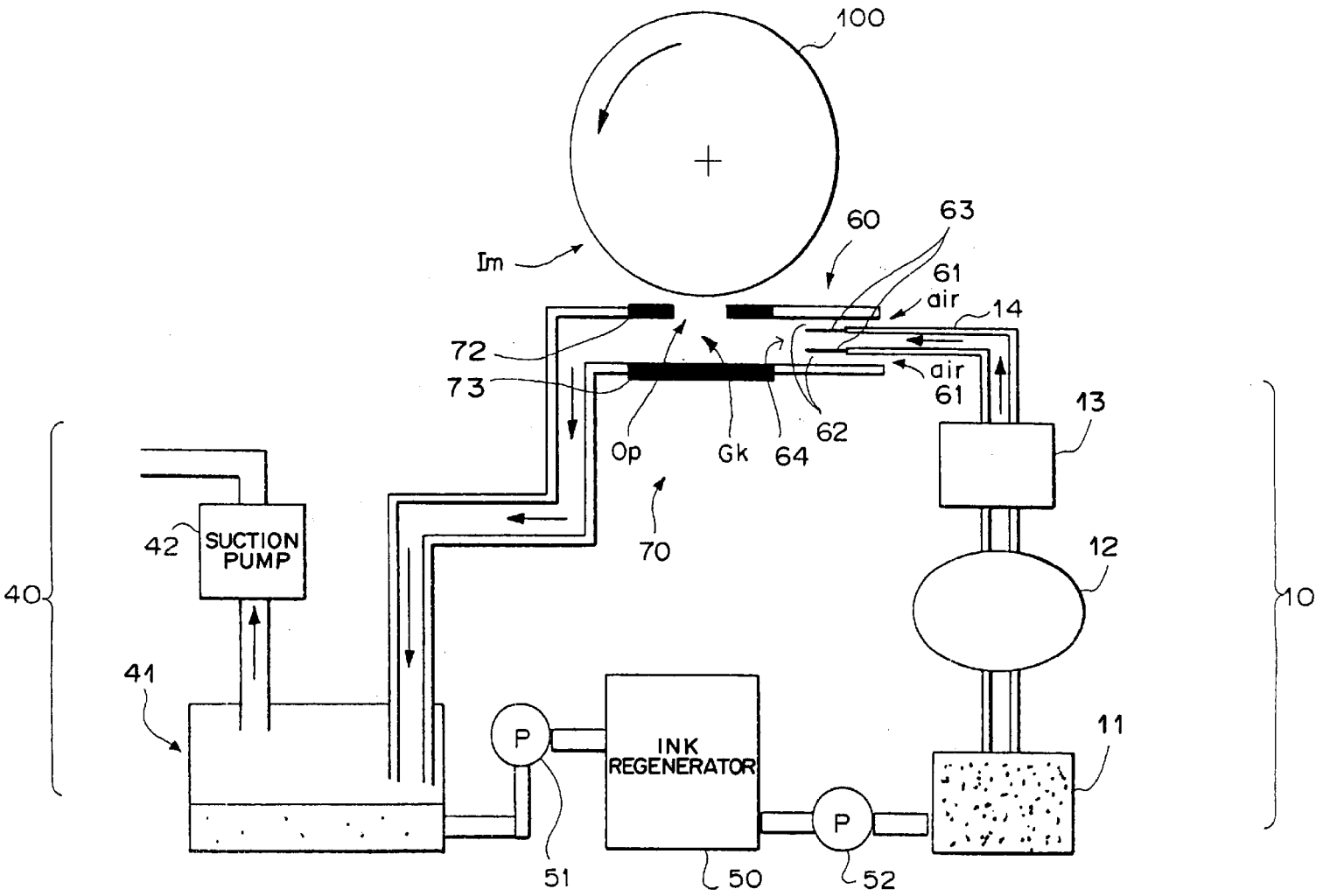
FIG. 5 is a schematic view showing a modification of the image forming apparatus of the second embodiment.

Further, though the electrostatic latent image support 100 is in the form of an endless belt in the embodiment described above, the electrostatic latent image support may be in the form of a rotary drum as shown in FIG. 5 or a flat plate.

When the space between the electrostatic latent image support 100 and the opening Op is not larger than 10 mm (more preferably not larger than 1 mm) , the electric field formed by the electrostatic latent image Im and the first and second bias electrodes 72 and 73 can be more properly controlled.

In place of the laminar flows of air, laminar flows of gas other than air, e.g., nitrogen, may be employed.

Further, though, in the embodiment described above, the charged mist comprises charged liquid particles dispersed in air or gas, charged mist comprising charged solid particles dispersed in air or gas may be used.

As can be understood from the description above, in accordance with the image forming apparatus of the second embodiment, a high quality image excellent in gradation and granularity can be developed without fog or unevenness in density. Further, vain consumption of ink can be saved.

What is claimed is:

1. An image forming method of developing an electrostatic latent image on an electrostatic latent image support by use of mist-like charged particles and thereby making visible the electrostatic latent image, the method comprising the steps of providing a developing electrode at a space from the electrostatic latent image support to extend substantially in parallel to the surface of the electrostatic latent image support on which the electrostatic latent image is formed, providing a gap control member on at least a part of the perimeter of the developing electrode to extend toward the surface of the electrostatic latent image support from the periphery of the developing electrode so that the space between the gap control member and the surface of the electrostatic latent image support is smaller than the space between the developing electrode and the surface of the electrostatic latent image support, thereby forming a developing space defined by the electrostatic latent image support, the developing electrode and the gap control member, and introducing mist-like charged particles into the developing space while applying an electric voltage to the developing electrode to form an electric field between the electrostatic latent image support and the developing electrode and moving the electrostatic latent image support and the developing space relative to each other.

2. An image forming method as defined in claim 1 further comprising the step of making a first pressure in the developing space lower than a second pressure outside of the developing space when the electrostatic latent image is to be developed.

3. An image forming method as defined in claim 1 further comprising the step of introducing gas free from the mist-like charged particles into the developing space through the space between the electrostatic latent image support and the gap control member.

4. An image forming method as defined in claim 1 further comprising the steps of introducing the mist-like charged particles into the developing space through a mist supply port provided on the developing electrode, and sucking the mist-like charged particles in the developing space through a mist suction port provided on the developing electrode.

5. An image forming method as defined in claim 1 further comprising the step of deflecting the mist-like charged particles to flow in a direction substantially parallel to the developing electrode by a deflector plate provided at a mist supply port.

6. An image forming apparatus for developing an electrostatic latent image on an electrostatic latent image support by use of mist-like charged particles and thereby making visible the electrostatic latent image, the apparatus comprising a developing electrode provided at a space from the electrostatic latent image support to extend substantially in parallel to the surface of the electrostatic latent image support on which the electrostatic latent image is formed, a gap control member provided on at least a part of the perimeter of the developing electrode to extend toward the surface of the electrostatic latent image support from the periphery of the developing electrode so that the space between the gap control member and the surface of the electrostatic latent image support is smaller than the space between the developing electrode and the surface of the electrostatic latent image support, thereby forming a developing space defined by the electrostatic latent image support, the developing electrode and the gap control member, a mist supply means for introducing mist-like charged particles into the developing space, an electric voltage application means which applies an electric voltage to the developing electrode to form an electric field between the electrostatic latent image support and the developing electrode, and a drive means for moving the electrostatic latent image support and the developing space relative to each other.

7. An image forming apparatus as defined in claim 6 further comprising a means for making a first pressure in the developing space lower than a second pressure outside of the developing space.

8. An image forming apparatus as defined in claim 6 in which the developing electrode is provided with at least one mist supply port for introducing the mist-like charged particles into the developing space and at least one mist suction port for sucking the mist-like charged particles in the developing space.

9. An image forming apparatus as defined in claim 6 further comprising a deflector plate provided at a mist supply port to deflect the mist-like charged particles to flow in a direction substantially parallel to the developing electrode.

10. An image forming apparatus as defined in claim 9 in which the deflector plate is formed of a conductive material.

11. An image forming apparatus as defined in claim 9 further comprising a means for applying to the deflector plate a bias voltage in the same polarity as the developing electrode.

12. An image forming apparatus as defined in claim 6 in which the gap control member is formed integrally with the developing electrode.

13. An image forming apparatus as defined in claim 6 in which the gap control member is formed of a conductive material.

14. An image forming apparatus as defined in claim 6 further comprising a means for applying to the gap control member a bias voltage in the same polarity as the developing electrode.

15. An image forming apparatus as defined in claim 6 in which the space between the electrostatic latent image support and the developing electrode is not larger than 10 mm.

16. An image forming apparatus as defined in claim 6 further comprising a recovery means for recovering non-used mist-like charged particles and a mist regenerating means for regenerating the recovered mist-like charged particles.

17. An image forming method of developing an electrostatic latent image on an electrostatic latent image support by use of mist-like charged particles and thereby making visible the electrostatic latent image, the method comprising the steps of providing a mist supply passage which has an opening in a position opposed to the electrostatic latent image support, forming a laminar flow of mist-like charged particles in the mist supply passage, forming a laminar flow of gas such as air free from the mist-like charged particles between the laminar flow of the mist-like charged particles and the inner surface of the mist supply passage at least on the side nearer to the electrostatic latent image support at least at a part of the mist supply passage near the opening, providing a first bias electrode near the opening of the mist supply passage, providing a second bias electrode on the inner surface of the mist supply passage opposite to the opening, and applying electric potentials to the first and second bias electrodes so that an electric field is formed in a direction perpendicular to the laminar flow of the mist-like charged particles and the mist-like charged particles are moved by the electric field toward the electrostatic latent image support passing through the laminar flow of the gas and the opening of the mist supply passage to adhere to the electrostatic latent image support and develop the electrostatic latent image.

18. An image forming method as defined in claim 17 in which the laminar flow of the gas is formed by providing an air passage along the inner surface of the mist supply passage at least on the side nearer to the electrostatic latent image support and making the pressure in the mist supply passage lower than the outside of the mist supply passage so that the gas flows into the mist supply passage from the outside of the mist supply passage through the air passage.

19. An image forming method as defined in claim 18 in which two air passages are formed along the inner surface of the mist supply passage on the side nearer to the electrostatic latent image support and the side remote from the same so that the laminar flow of the mist-like charged particles is sandwiched between laminar flows of the gas formed on the side nearer to the electrostatic latent image support and the side remote from the same.

20. An image forming apparatus for developing an electrostatic latent image on an electrostatic latent image support by use of mist-like charged particles and thereby making visible the electrostatic latent image, the apparatus comprising a mist supply passage which has an opening in a position opposed to the electrostatic latent image support, a means for forming a laminar flow of mist-like charged particles in the mist supply passage, and a means for forming a laminar flow of gas such as air free from the mist-like charged particles between the laminar flow of the mist-like charged particles and the inner surface of the mist supply passage at least on the side nearer to the electrostatic latent image support along at least a part of the mist supply passage near the opening, wherein the mist-like charged particles are moved toward the electrostatic latent image support passing through the laminar flow of the gas and the opening of the mist supply passage to adhere to the electrostatic latent image support and develop the electrostatic latent image.

21. An image forming apparatus as defined in claim 20 further comprising a means for making a first pressure in the mist supply passage lower than a second pressure outside of the mist supply passage.

22. An image forming apparatus as defined in claim 20 further comprising an electric field forming means which forms an electric field in a direction perpendicular to the laminar flow of the mist-like charged particles in a position opposed to the electrostatic latent image support.

23. An image forming apparatus as defined in claim 22 in which the electric field forming means comprises a first bias electrode provided near the opening of the mist supply passage between the electrostatic latent image support and the laminar flow of the gas free from the mist-like charged particles formed on the side of the laminar flow of the mist-like charged particles nearer to the electrostatic latent image support, and a second bias electrode which is provided opposed to the first bias electrode with the laminar flow of the mist-like charged particles intervening therebetween.

24. An image forming apparatus as defined in claim 23 in which the first bias electrode is a slit electrode having a plurality of slits.

25. An image forming apparatus as defined in claim 20 in which the space between the electrostatic latent image support and the opening is not larger than 10 mm.

26. An image forming apparatus as defined in claim 20 further comprising a recovery means for recovering non-used mist-like charged particles and a mist-like charged particle regeneration means which regenerates mist-like charged particles from the recovered charged particles.

* * * * *